US005459377A

United States Patent [19]

Yue

[11] Patent Number: 5,459,377

[45] Date of Patent: Oct. 17, 1995

[54] METHOD FOR STARTING GAS-CONDUCTING LAMP AND LAMP FOR CARRYING OUT THE METHOD

[75] Inventor: Zheng Yue, The Soverign #2001, 99 Meyer Rd., Singapore 1543, Singapore

[73] Assignees: Zheng Yue; Brian Chang; Lau K. Kim , all of Singapore

[21] Appl. No.: 174,233

[22] Filed: Dec. 28, 1993

[51] Int. Cl.[6] ..... H05B 37/00

[52] U.S. Cl. ..... 315/289; 315/290; 315/244; 315/247; 315/DIG. 5

[58] Field of Search ..... 315/289, 290, 315/244, 100, 89, DIG. 5, 247, 227 R, 240

[56] References Cited

U.S. PATENT DOCUMENTS

| | | | |
|---|---|---|---|
| 3,383,558 | 5/1968 | Waymouth | 315/242 |
| 3,628,086 | 12/1971 | Nuckolls | 315/100 X |
| 5,289,084 | 2/1994 | Nuckolls et al. | 315/290 X |

FOREIGN PATENT DOCUMENTS

| | | |
|---|---|---|
| 0331840 | 11/1988 | European Pat. Off. . |
| 0450523A1 | 3/1991 | European Pat. Off. . |
| 1485918 | 7/1975 | United Kingdom . |
| WO89/06085 | 6/1989 | WIPO . |

*Primary Examiner*—Robert J. Pascal
*Assistant Examiner*—Haissa Philogene
*Attorney, Agent, or Firm*—Lackenbach Siegel Marzullo Aronson & Greenspan

[57] ABSTRACT

According to this invention, there is provided a method for starting a gas-conducting lamp, by which a gas-conducting lamp is started directly by a high-voltage without pre-heating of filament. Such a high-voltage is realized by an inductor-capator resonant circuit (LC resonant circuit) or a tap of an inductor. According to this invention, there is also provided a gas-conducting lamp for carring-out the above-mentioned method. The method according to this invention is simple and effective and is adapted to the use of a gas-conducting lamp without filament or that with filament which has been broken or has failed.

7 Claims, 4 Drawing Sheets

METHOD FOR STARTING GAS-CONDUCTING LAMP AND LAMP FOR CARRYING OUT THE METHOD

BACKGROUND OF THE INVENTION

1. Field of the Invention

The present invention relates to the field of electrical illumination, in particular, to a method for starting a gas-conducting lamp and the lamp for performing the method.

2. Background of the Invention

The conventional gas-conducting lamp has the advantage of high luminiferous efficiency, but its disadvantage is that the life of the lamp depends on the life of the filament, i.e. if the filament falls, the costly lamp tube will be out-of-service. Although producers of the lamps makes a great effort to improve the life of the filament, such an improvement is limited. The second disadvantage is that the gas-conducting lamp is hard to be started when the voltage from the electirc power is low; and the third disadvantage is that the starting may last for a certain period of time, such as several seconds to tens of seconds for a daylight lamp, and last tens of seconds to several minutes for high-voltage mercury lamp.

SUMMARY OF THE INVENTION

The object of the invention is to solve the problems existing in the prior art by providing a simple and effective method for starting gas-conducting lamps and a gas-conducting lamp comprising a starter for realizing the method.

Another object of the invention is to provide a method for starting filamentless gas-conducting lamp.

Still another object of the invention is to prolong the life of gas-conducting lamps or to utilize conventional lamp tubes with filaments which have been broken or have failed.

According to the invention, there is provided a method for starting a gas-conducting lamp, comprising the following steps: providing a means for producing a high-voltage; producing a high-voltage and to disrupt the gas in the lamp tube to start.

According to the invention, there is also provided a method for starting a gas-conducting lamp, comprising the following steps: providing a resonance circuit comprising an inductor L and a capacitor C; producing a great instantaneous resonent current by the resonant circuit; and cutting out the resonant current to produce an inductive high-voltage at two ends of the inductor C sufficient to start instantaneously the gas-conducting lamp.

According to the invention, there is also provided a gas-conducting lamp comprising a lamp and a stater wherein the stater comprises an inductor L and a capacitor C, and the inductor L and the capacitor C form a resonant circuit which resonant at or near the power frequency, the starter further comprising a switch $K_1$, which is a switch for starting, while it turns on, the LC resonant circuit turns on and a large resonant current passes through the inductor or L, while it turns off, the large resonant current is cut off and an inductive high voltage is applied to two ends of the inductor 1 to start the gas-conducting lamp directly.

According to the invention there is still provided a gas-conducting lamp comprising a lamp tube and a starter, wherein the stater comprises an inductor L, a capacitor C, a double contact switch connecting with the lamp tube, and the inductor L is connected with the capacitor C in series while an electrode O of the double contact switch contacts with the second contact B, and the inductor L is connected with the capacitor C pararrel while the electrode O contacts with the first contact A; While electrode O is firstly connected and then disconnected with the second contact, an instantaneous inductive high-voltage produced by the inductor L applies to two ends of the lamp tube R to start the lamp, while the electrode O contacts with the first contact, the parallel circuit constituted by the inductor L and the capacitor C has a large impedance which has a series current-limiting effect for the working current passing through the lamp tube R.

According to the invention, there is still provided a gas-conducting lamp comprising a lamp tube and a starter, the stater comprises an inductor L and a contact switch $K_5$, wherein the inducter $L_5$ is connected with the lamp in series, and the contact switch $K_5$ is connected with the lamp in parallel, a high-voltage produced by the inductor L while the contact switch turns off is applied to the lamp to start the lamp.

According to this invention, there is also provided a gas-conducting lamp, wherein the lamp tube R is not provided with a filament or is only provided broken or failing filament, and the electrods has a ball shape, and the lamp is started by an instantaneous high-voltage.

DESCRIPTION OF THE DRAWINGS

The invention will be more apparent through the following description with the dawings, in which.

DETAILED DESCRIPTION OF THE INVENTION

A basic method according to the invention is as follows: a series LC circuit is provided to produce a great resonant current; the resonant current is then cut out to obtain an instantaneous high voltage at two ends of the inductor L; such a high voltage is applied to a lamp tube (or bulb) to disrupt the gas in the lamp tube and change the gas to a conductor; and then an appropriate current is applied to the lamp tube to form stable current in the lamp tube and make the lamp illuminate.

Although the process of lighting a lamp tube by high voltage at two ends of an inductor obtained by cutting off of the circuit is also used for the conventional gas-conducting lamp (such as the daylight lamp), the current is small due to the high impedance of a simple LR circuit, therefore, when cutting out the circuit, no voltage so high to disrupt the gas in the lamp tube can be formed, and the starting of the lamp needs to be performed by preheating the filament, thus producing a series of problems caused by the filament heating. According to the invention, the capacitive reactance of a capacitor connected in series with the inductor L cancels the inductive reactance of the inductor L to obtain a lower impedance in the LC series resonant circuit, therefor the high voltage produced by cutting out the current is sufficient to disrupt the gas in the lamp tube, thus it is not necessary to preheat a filament, that is to say, it is not necessary to provide a filament.

Figure 1:
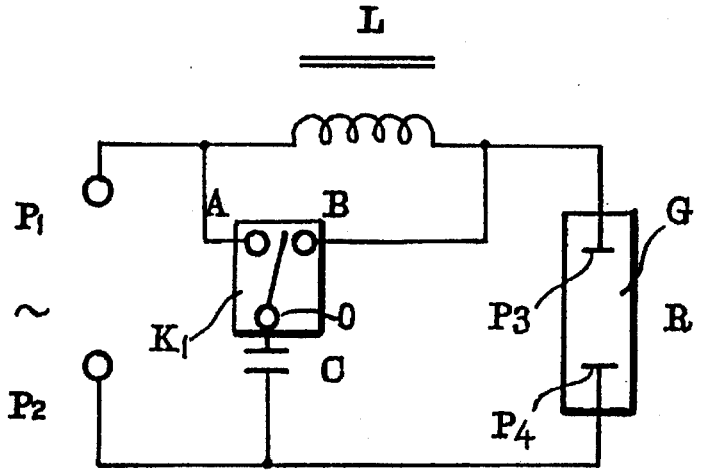
FIG. 1 shows a basic circuit of the invention.

FIG. 1 shows a basic circuit of the starter of the invention, wherein R designates a gas-conducting lamp tube. In the condition as shown in FIG. 1, the electrode O and the second contact B are connected, and an alternating current being applied to the electrodes $P_1$ and $P_2$ of the power passes through an inductor L and a capacitor C to form a LC circuit, wherein the inductance of the inductor and the capacitance of the capacitor are set to resonate to the frequency of the power, the formulas for calculating the resonant frquency belong to basic formulas in the electrical engineering field and are omitted here. While L, C are resonant with the frequency of power, a great resonant current is formed. In that time, the electrode O is changed to connect with the first contact A and to disconnect with the second contact B, so that a high voltage is formed at two ends of the inductor because the current in the circuit is changed to zero instantaneously. The high voltage is applied to two ends of the gas-conducting lamp tube to disrupt the gas in the tube R to be conducted. In that condition, the power is supplied to the tube R to illuminate through the current-limiting of the inductor L, and the circuit is as follow: the power-$P_1$-L-R-$P_2$-the power, thus forming a constant circuit for illumination. After the first contact A is connected, the capacitor is parallel to the L-R circuit and play a role to increase the power factor.

Figure 2:
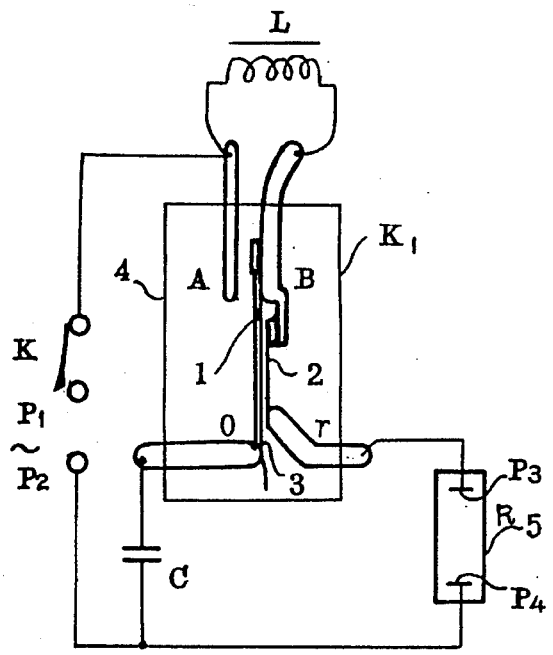
FIG. 2 shows another embodiment of the invention, showing a starting condition.
Figure 3:
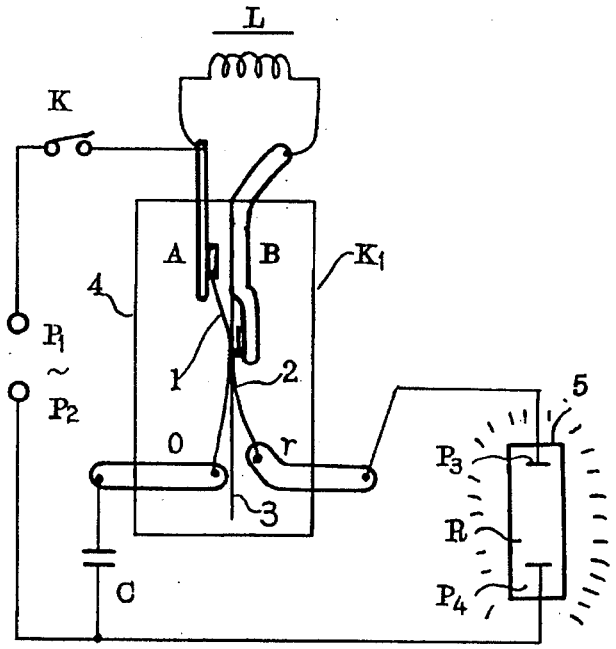
FIG. 3 shows an illuminating condition of the embodiment shown in FIG. 2.

Furthermore, an embodiment of the present invention used for a dayliglt lamp is described. A basic structure of the embodiment is shown in FIGS. 2 and 3. FIG. 2 shows a starting condition. When the switch K is turn on, the alternating power, via electrodes $P_1$, $P_2$, forms a circuit with an inductor L, a second contact B, a bimetal 1, an electrode O and a capacitor C. Because the inductance of the inductor L and the capacitance of the capacitor are resonant with the frequency of the power, in the circuit there passes a great series resonant circuit current. Such a great current passes through the bimetal 1 to cause it bend due to the different thermal conductivities of the bimetal, and the bend projects to the second contact B. That is, the contact head of the bimetal 1 contacts with the first contact A. Since the resonant circuit is cut out due to the disconnection of the bimetal 1 and the second contact B, a high voltage is produced-at two ends of the inductor L. Such a high voltage is applied to the two ends of the gas-conducting lamp tube (i.e. a day light lamp for this embodiment) by passing through the switch K, the electrode $P_1$, the power, the electrode $P_2$ to the second electrode $P_4$ of the gas-conducting lamp tube and through the inductor L, the bimetal 2, the electrode r to the first electrode $P_3$ of the gas-conducting lamp tube R to disrupt the gas in the tube to be conductive. By the current-limiting effect of the inductor L, a constant circuit is formed through the power, the switch K, the inductor L, the second contact B, the bimetal 2, the electrode r, the first electrode $P_3$ and the second electrode $P_4$ of the lamp and the electrode $P_2$ as shown in FIG. 3, therefore the lamp tube R is light and illuminant. When the illuminating current passes through the bimetal 2, the latter is bent due to the different thermal conductivities, and the bending projects to bimetal 1. The bimetal 1 is pushed by the bimetal 2, via an insulating paper 3, to disconnect with the second contact B and to connect with the first contact A, so that the capacitor C is parallel with the L-R circuit thus increasing the power factor. If the abovementioned starting can't disrupt the gas in the lamp tube R once, in the bimetal 2 there is no current passes through, so that the bimetal 2 is not bent to push the bimetal 1, and the bimetal 1 returns to connect with the second contact B, and a great resonant current passes again, and the bimetal 1 is bent again to disconnect with the second contact B. The abovementioned steps repeat till the gas in the lamp tube R is disrupted, the bimetal 1 contacts with the first contact A under the push of the bimetal 2 and the lamp lightens and illuminates. The insulating paper 3 is used to separate the bimetals 1 and 2 to let them abut against each other but be not electric-conductible. Alternatevely, an insulating layer may coat on the bimetals 1 and 2 to separate them. After the switch K turns off, the bimetals 1 and 2 return to all contact the second contact B due to cooling in the case that no current passes through until the next starting.

The design of the bimetals 1 and 2 should make them be effectively bent under the resonant current during starting and the working current during illumination to ensure a reliable disconnection, abuting and pushing action and make them be bent quickly under the heated condition by passing current, and the transient time should be short, thus ensuring a quick and reliable starting and working of the lamp. The distance between the first and second contacts A and B should not be too short to prevent from disrupting them by the high-voltage of the inductor L. Generally, the inductance of the inductor L and the capacitance of the capacitor C should ensure resonance with the frequency of the power (i.e. 50 Hz or 60 Hz) and their values are set under consideration of the reasonable current-limiting in the illumination power.

For the bimetals 1 and 2, other metal parts (such as a memory alloy) which may have a shape change while the current passes through may be used. In FIGS. 2 and 3, reference number 4 denotes a casing of a starter, which encases the first and second contacts A and B, the electrodes O and r and the bimetals 1 and 2 as well as the insulating paper 3. The size of the whole starter may be less than a finger. Reference numeral 5 denotes a casing of lamp tube R, which is generaly a closed glass tube.

Figure 4:
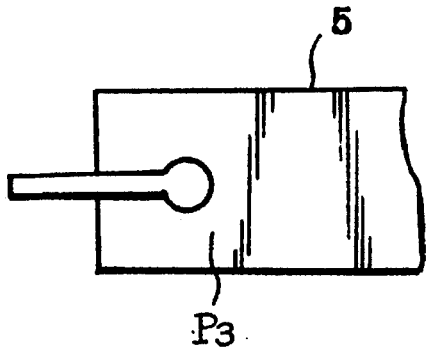
FIG. 4 shows an embodiment of the electrode of the lamp tube.

It should be noted that the gas-conducting lamp adapted to the starter according to the invention has not filament i.e. it is a gas-conducting lamp without filamant (or ZY lamp). The shape of the electrode in the tube (such as $P_3$, $P_4$ as shown in FIGS. 2 and 3) can be set only under consideration of stable discharge. For example, an electrode of ball shape is used. As shown in FIG. 4, the electrode $P_3$ in the tube 5 is of ball shape to avoid an unstable discharge caused by a sharp metal electrode, which is a problem easily caused by the conventional gas-conducting lamp with filament. The electrode in ZY lamp may be coated with material which easily emit electrons.

Alternatevely, the ZY lamp may be lighted by a direct-current power. In this case, the lamp is non-flash since filament is not used, the filament part in the electron-curcuit of the prior direct-current lamp may be deleted, and the lamp tube is lighted by the principle of resonance with series LC circuit according to the invention. However, when a rectified circuit is added to illuminate, the current passing through the lamp tube is a direct-current. The ZY lamp has simple structure and does not increase the numbers of elements and lowers cost due to deleting lamp filament. For utilization, the life of lamp tube is increased greatly because there is no filament, therefore, the lamp has economical benefit and reliability for utilization. Further, an intantaneous start may be performed by once-through operation, and the lamp tube may be started within one second. Further, the start is performed by the high voltage during cut-out of the LC resonout circuit, therefore, when the voltage of the power is lowered to a lower lever, starting and working is still reliable. In the case that there is not desired a higher starting voltage to start the lamp tube, the value of the inductor L and the capacitor C is not necessary to resonate correctly with the power frequency. For example a small value of the capacitor C or deleting the capacitor C are all practicable. The ZY lamp according to the invention may replace the prior lamp directly. For example, the prior daylight lamp may continue to be used without change of the ballast L and the lamp tube. Before the ZY lamp governs the market completely, the prior daylight lamp (even if the lamp has broken filament) may all be used for the ZY lamp to light and illuminate.

The principle of the invention may be used to start in the case that bimetals are not used. The key solution is that in the illuminating circuit which is connected in series with the lamp tube R, there is connected in series a "illuminating Key" $K_2$ take the role as that of the bimetal 2 and the second contact B (as shown in FIGS. 2 and 3). Further, a starting switch Ktaking the role as that of the bimetal 1 and the first contact A is connected in series in the LC circuit. When starting, the switch $K_1$ firstly turns on and then turns off. The key $K_2$ may make the switch $K_1$ keep on the turning off position by means of an electrical, magnetic, luminous, thermal and mechanical manners while a working current for illumination passes after the lamp tube being disrupted. Otherwise, without the effect of the key $K_2$, the switch $K_1$ may return to a turning-on position and then turns off to repeat the starting action until the starting is realized. For example, the switch $K_1$ is an electro-magnetic relay, when through the key $K_2$ passes a working current, an electro-magnetic force makes the switch $K_1$ keep in turning-off condition, otherwise, the switch $K_1$ may turn on again. Or, the switch $K_1$ is a thermal relay, when though the key $K_2$ passes a working current, a thermal force makes the switch $K_1$ keep in turning-off condition, otherwise, the switch $K_1$ may turn on again. The switch $K_1$ may be a photoelectric relay, while through the key $K_2$ passes a working current, a fight illuminates the switch $K_1$ to make it keep in turning off condition, otherwise, the switch $K_1$ may turn on again. That is, many different models in the prior art may be used.

Figure 5:
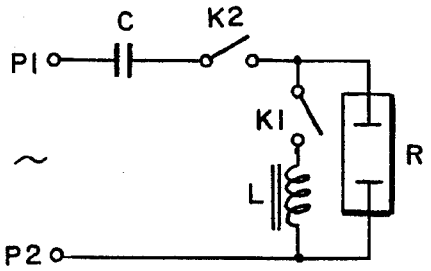
FIG. 5 shows still another embodiment of the invention.

The positions of the inductor L and the capacitor C may be exchanged each other, i.e. the capacitor C is connected with the lamp R and the electrodes $P_1$ and $P_2$ of the power (as shown in FIG. 5). While both the switch $K_1$ and the key $K_2$ turn on, the inductor L and the capacitor C connected in series to resonate. While the key $K_2$ turns off, a high inductive voltage at two ends of the inductor L to start the lamp tube R instantaneously. Then, the switch $K_1$ turns off and the key $K_2$ turns on , the lamp tube R is connected with the power through the voltage-lowering and the ballasting of the capacitor C to illuminate. Also, the inductor L may be a autotransformer, and the capacitor C only connects in series with part of the winding of the inductor C, thus lowering the volume and the cost of the inductor L.

Moreover, there are still many modifications of the invention. For example, in the starter, a capacitor and an inductor are connected in parallel so that the capacitive reactance complements the inductive reactance, thus the impedance of the parallel circuit is greater than the inductive reactance of a single inductor. When the parallel inductor and capacitor are resonant to power frequency, the parallel circuit has the largest impedance with regards to the power. Even if a resonant condition is not obtained, the impedance has to also be increased greatly due to the parallel connection of the inductor and the capacitor, therefore, the inductance of the inductor L can be reduced, generally by 20%–80%, thus the cost and weight of the inductor are reduced greatly.

Figure 6:
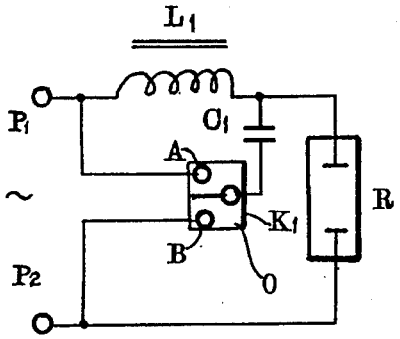
FIG. 6 shows another embodiment of the invention.

One of the typical circuits is shown in FIG. 6. The power is applied from the electrodes $P_1$ and $P_2$. When the electrode O of the double contact switch is connected with the first contact A of the double contact switch, a large current passes through the series resonant circuit constituted by an inductor L and a capacitor C and resonant with the power frequency. Then, the electrode O is disconnected from the second contact B, an instantaneous high voltage is produced at two ends of the inductor $L_1$ for starting the lamp tube R. The electrode O then is connected with first contact A, so that the capacitor connects with the inductor L in parallel to form a parallel resonant circuit with regards to the power frequency, which has a large impedance, and a perfect series current-limiting effect, therfore a stable working current passes through the lamp tube R. In that case, the inductance of the inductor $L_1$ may be very small and the cost and the weight are reduced. Further, the parallel connection of the inductor $L_1$ and the capacitor C also takes a role to increase the power factor. For the working condition of a common daylight lamp, even if the inductance and the capacitance are smaller than that are necessary for a parallel resonance, the lamp will still be started smoothly and the working current will be limited.

Figure 7:
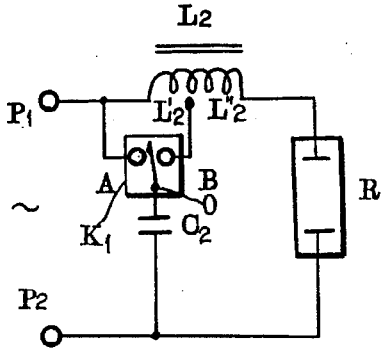
FIG. 7 shows another embodiment of the invention.

In order to further reduce the cost and weight of the inductor by further reducing the inductance, the inductor may be formed as one with a median tap to obtain a sufficient high-voltage for starting by the voltage-increasing of the autotransformer. A typical circuit is shown in FIG. 7, wherein the second contact B connected with a median tap of the inductor $L_2$. When the second contact B connects with the electrode O, a great current passes through the series circuit comprising an inductor $L_2$, which is the left portion from the mediam tap of the inductor $L_2$ and the capacitor $C_2$. When the electrode O is disconneted with the second contact B and connects with the first contac A, an instantaneous high-voltage is formed at the two ends of the inductor $L_2$ and a higher-voltage is obtained at the two ends of the inductor L2 by the voltage-increasing function of autoformer of the inductor $L_2$ to start the lump tube R. After the electrode O connects with the first contact A, the inductor $C_2$ takes a role to increase the power factor. With the function of autotransformer, a very high instantaneous high-voltage may be obtained in the case that the inductor $L_2$ has a less number of turns on the whole, thus the cost and weight of the inductor $L_2$ may be further decreased.

Figure 8:
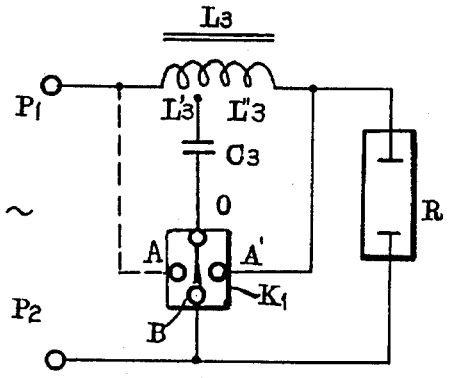
FIG. 8 shows another embodiment of the invention.

By combining the principles of FIG. 6 and FIG. 7, a typical circuit as shown in FIG. 8 is obtained. The inductor $L_3$ has a median tap and is an autotransformer. When the second contact B connects with the electrode O, a great current passes through the series circuit comprising the inductor $L_3$ which is the left portion from the median tap of the inductor $L_3$ and the capacitor C3. When the electrode o is disconnected with the second contact B, an instantaneous high-voltage is formed at two ends of the inductor $L_3$, a higher voltage is obtained at two ends of the inductor $L_3$ by the voltage-increasing function of the autotransformer to start the lamp tube R. After the electrode O is disconnected with the second contact B, the former connects with the first contact A, so that the capacitor $C_3$ is parrallel with the inductor $L_3$" which is the right portion from the median tap of the inductor $L_3$ to make the capacitive reactance complement the inductive reactance, thus the parallel resonant circuit has a great impedance. Then, under the self-inductance function of the inductor $L_3$, the impedance of the inductor $L_3$ is increased greatly to have a good current-limiting effect. Therefore, the inductance of the inductor L3 may be small, and the cost and weight are decreased. As shown in FIG. 8, after the electrode O is disconnected with the second contact B, the former connects with the contact A, thus, the capacitor C3 is parallel with the inductor L3 which is the left portion from the median tap of the inductor L3, via a circuit as show, in dotted line, to complement the inductive reactance. The complementary effect depends on the position of the tap of the inductor L3 and the capacity of the capitor C3.

Figure 9:
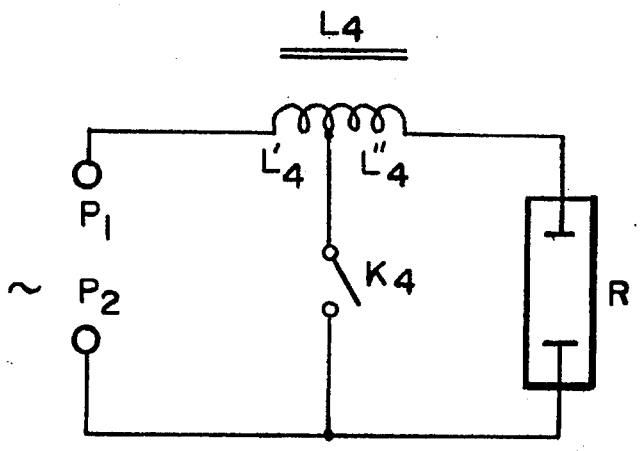
FIG. 9 shows another embodiment of the invention.

For daylight lamp, it is possible to further simplify the circuit and delete the capacitor because the starting voltage is unnecessary to be very high. As shown in FIG. 9, a median tap of the inductor $L_4$ connects with the electrode $P_2$, via a switch $K_4$ to form a circuit with the power supplied from the electrodes $P_1$, $P_2$, and a considerable large current passes through above circuit. When the switch $K_4$ is disconnected, a high-voltage is produced at two ends of the inductor $L_4$ which formed by the left portion of the inductor $L_4$ by induction and is increased by the autotransformer function of the inductor $L_4$ to start the lamp tube R. If necessary, the switch $K_4$ is connected with a resistance to limit the current.

Figure 10:
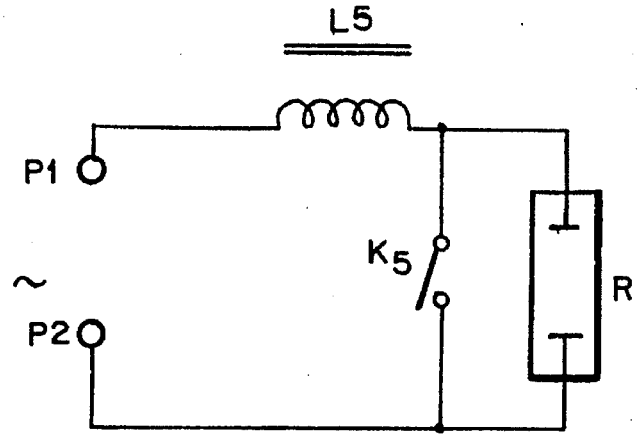
FIG. 10 shows another embodiment of the invention.

FIG. 10 shows a further simple construction. The switch $K_5$ connects directly with the lamp tube R in paralle. When the switch $K_5$ is disconnected, the high-voltage produced by the inductor L5 may start the lamp tube R directly in the case that the lamp tube R has a short length.

For the construction as shown in Figures by 10, the electrode O, the contact B and the switches $K_4$, $K_5$ are used for cutting off the current in the inductive circuit during starting, so that their structures shall meet the following desirements, i.e. the response time for disconnecting is short, the equivalent parallel capacity (equivalent to that is connected at two ends of the electrodes O, B or switchs K4, K5 in parallel as regards to the construction) is as small as possible, thus the current in the inductive circuit may be decreased to zero quickly while cutting off, to produce a higher voltage at two ends of the inductor. The above mentioned behaviours are emphasized for the circuits as shown in FIGS. 9, 10 especially in FIG. 10.

The form of the contact switch may be various as mentioned above. If a bimetal is used, the contact B, the electrode r and the bimetal 2 (as shown in FIGS. 2 and 3) should be connected in series with one end of the lamp tube R to only let the working current pass through the lamp tube R (FIGS. 5 to 10), and not be connected in series in the tapping circuit as shown in FIG. 7 to FIG. 9.

The construction of the embodiments according to the inventionh may be gas-conducting lamp with or without filament, and the filament may be broken or may fail.

We claim:

1. A starting circuit for a gas-conducting lamp comprising a lamp tube without a filament; first and second contacts for connecting the circuit to a source of power at a predetermined power frequency; a single inductor series connected with said contacts and with said lamp tube; a single capacitor; and switching means for switching said capacitor between a first condition in which said capacitor is connected in LC resonance with said inductor for producing a large instantaneous resonant current at said power frequency and a second condition in which said capacitor ceases to be in LC resonance with said inductor to produce a high inductive voltage accross said lamp tube to start said lamp tube and to increase the power factor and/or series impedance of the circuit by said capacitor during the operation of said lamp tube.

2. A starting circuit as defined in claim 1, wherein said switching means comprises a switch having two fixed contacts respectively connected to opposite terminals of said inductor, which is connected to said first contacts and an adjustable common contact, said capacitor being connected between said adjustable contact and said second contact.

3. A starting circuit as defined in claim 1, wherein said switching means comprises a temperature-sensitive bimetallic element for switching from said first to second conditions upon heating of said bimetallic element by said resonant current during starting of said lamp tube.

4. A starting circuit as defined in claim 1, wherein said inductor has a median tap and said capacitor is connected to said median tap in said first condition.

5. A starting circuit as defined in claim 1, wherein said switching means comprises a switch having two fixed contacts respectively connected to said first and second contacts and an adjustable contact, said capacitor being connected between said adjustable contact and a point intermediate between said inductor and said lamp tube.

6. A starting circuit as defined in claim 1, wherein said inductor has a median tap, and said switching means has at least two fixed contacts and an adjustable common contact, said inductor being connected between said lamp tube and said first contact, one fixed contact being connected to one side of said inductor and another fixed contact being connected to said second contact, said capacitor being connected between said median tap and said adjustable contact.

7. A starting circuit as defined in claim 6, wherein said switching means comprises an additional fixed contact connected to another said of said inductor.

* * * * *